United States Patent [19]

Kemp et al.

[11] 4,375,213

[45] Mar. 1, 1983

[54] SELF-CLEAN OVEN

[75] Inventors: Wayne T. Kemp, Kutztown; Domenick Saponara, Macungie, both of Pa.

[73] Assignee: Raytheon Company, Lexington, Mass.

[21] Appl. No.: 200,301

[22] Filed: Oct. 23, 1981

Related U.S. Application Data

[63] Continuation of Ser. No. 963,603, Nov. 24, 1978, abandoned.

[51] Int. Cl.[3] ..... A21B 1/26; F24C 15/32

[52] U.S. Cl. ..... 126/21 A; 126/237; 126/273 A; 219/400

[58] Field of Search ..... 126/21 A, 273 R, 214 A, 126/214 D, 198, 193, 19 R, 273 A; 219/400, 399, 10.55 R, 10.55 D, 10.55 E, 10.55 F, 10.55 B, 10.55 M; 312/236; 98/115

[56] References Cited

U.S. PATENT DOCUMENTS

| | | | |
|---|---|---|---|
| 2,839,044 | 6/1958 | Phares | 126/273 A X |
| 3,364,912 | 1/1968 | Dills et al. | 126/21 A |
| 3,422,809 | 1/1969 | Perry | 126/21 A |
| 3,480,000 | 11/1969 | Torrey et al. | 126/21 A |
| 3,911,893 | 10/1975 | Baker et al. | 126/21 A |
| 3,973,551 | 8/1976 | Caselani et al. | 126/21 A |

*Primary Examiner*—Larry Jones

*Attorney, Agent, or Firm*—William R. Clark; Milton D. Bartlett; Joseph D. Pannone

[57] ABSTRACT

A self-clean oven having means for passing cooling air over the heated walls of the oven and further having means for supplying combustion air by normal inspiration to the oven burners independently of the flow of cooling air, and having still further means for mixing hot combustion products exhausted from the interior of the oven with exhausted cooling air to prevent passage of excessively hot air into the atmosphere.

10 Claims, 3 Drawing Figures

SELF-CLEAN OVEN

CROSS-REFERENCE TO RELATED CASES

This is a continuation of application Ser. No. 963,603, filed Nov. 24, 1978, now abandoned.

BACKGROUND OF THE INVENTION

The present invention relates to gas-fueled ovens and particularly to built-in wall ovens having pyrolytic self-cleaning capability. Built-in wall ovens of conventional construction have been manufactured in a manner such that insufficient heat will escape to damage adjacent surfaces of the walls or other enclosing and supporting structures. However, such ovens were adapted to be operated at normal baking and broiling temperatures which generally did not exceed 500°-550° F. Accordingly, it has been a relatively simple matter to sufficiently insulate the oven so that damage to adjacent structure would not occur.

However, heretofore it has not been practical to provide built-in wall ovens with pyrolytic self-clean capability because pyrolytic self-clean ovens are operated during a cleaning cycle at temperatures which may reach as high as 900°-1100° F. In such cases damage would easily be incurred by wall and supporting structure which encloses the ovens. It was found that such damage would occur as a result of the escape of high temperature heat particularly through the side and back walls and the floor of the ovens.

Attempts have been made to overcome this problem by providing flues along the back, sides and bottom of the oven to permit flow of cooling air which will keep the temperature of the surfaces below the danger point. While this did aid in maintaining the temperatures at safe levels when the ovens were used for baking and broiling operations, there arose an additional problem which came about when it was found that gas pilot burners tended to become extinguished, and the main burners were either partly or completely extinguished with the resultant danger of production of excessive amounts of CO and $CO_2$.

SUMMARY OF THE INVENTION

The above and other objections to prior art gas-fueled built-in wall ovens are overcome in the present invention wherein oven surfaces adjacent to surrounding walls of the enclosure are maintained at relatively cool and safe temperatures during operation of the ovens at pyrolytic temperatures. This is accomplished by employing at least one fan or blower with suitable ducting to circulate cooling air over oven surfaces which are located adjacent to walls and floor of the enclosure.

In accordance with this invention, the passageways or ducts and the entrance points for the cooling air supply are separated from those for the combustion air to the burners. Thus, the air drawn into the cooling flues by the fans or blowers will not diminish the air drawn into the burner compartments, allowing the burners to be supplied with combustion air unaffected by the flow of the cooling air.

In further accordance with this invention is the provision of a circulation system in an oven wherein the temperature of exhaust gases during a pyrolytic operation is reduced by mixing the exhausted cooling air with exhausted combustion products at their exit points. This is achieved by exhausting the hot combustion products through an opening which is located immediately below and between cooling air exhaust openings so that upon being exhausted the hot combustion air will, upon rising, almost immediately mix with the exhausted cooling air, thus reducing the overall temperature of the combustion air so that air of dangerously high temperature will not pass into the ambient atmosphere in the room.

BRIEF DESCRIPTION OF THE DRAWINGS

The foregoing and other objectives of this invention will become apparent from the following description taken in connection with the accompanying drawings, wherein.

DESCRIPTION OF THE PREFERRED EMBODIMENT

Figure 1:
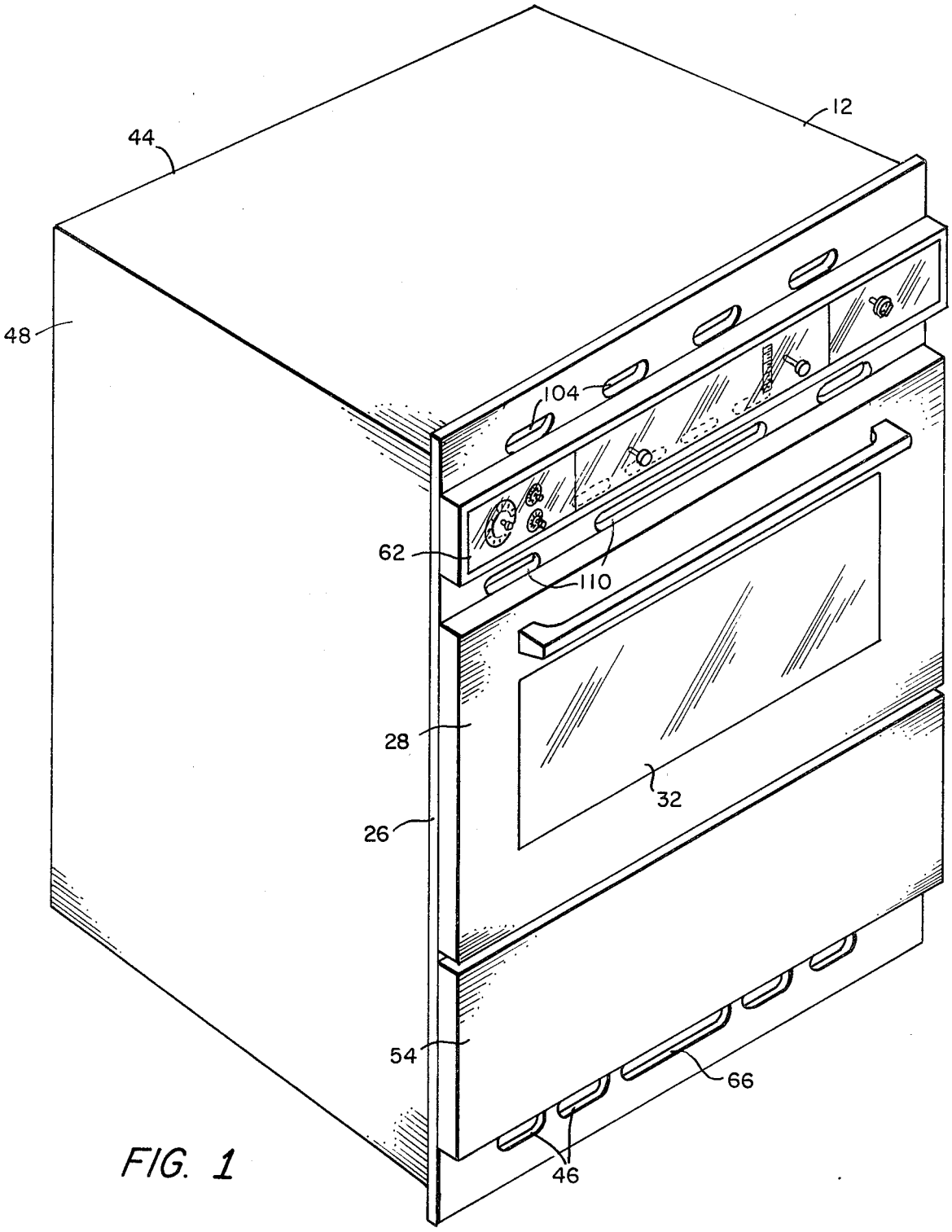
FIG. 1 is an isometric view of a wall oven embodying the invention.

Referring more particularly to the drawings wherein like characters of reference designate like parts throughout the several views, the present invention is illustrated as adapted to a domestic wall oven of the type which may be built into the wall of a kitchen of a home, for example. While the presently described invention is particularly suitable for wall-mounted installations, it is to be understood that it also can be used in the ovens of free-standing stoves or ranges and, therefore, this invention is not limited to the wall-mounted application.

In the present description, it is believed unnecessary to show and describe well-known and conventional parts such as gas manifold, mixing chambers, control valves, etc. since they do not in themselves constitute any part of the present invention. For the purpose of this disclosure, it is believed sufficient to point out that free-standing, or floor supported, ranges and wall-mounted installations both include a substantially box-like metal body 12 containing within it a substantially box-shaped metal liner 14 which defines an oven cooking cavity 16 or compartment. Liner 14 includes a rear wall 18, a top wall 20, a bottom wall 22, a front wall 24 and a pair of side walls 25. The interior surfaces of the liner 14 may be finished in any conventional manner such as, for example, by bearing a layer (not shown) of porcelain enamel of the glass-frit type. An opening 26 is provided in the front wall 24 of the liner 14 whereby the interior of the oven cooking cavity 16 is accessible from the body 12. A door 28 is mounted on the front of the body 12 by a suitable hinge structure (not shown) whereby the door is pivotally movable into open or closed relation with respect to the open front of the cavity 16. The door hinge and latching structures are not shown and do not constitute in themselves part of the present invention.

The liner top wall 20, rear wall 18 and side walls are enclosed by bolts 30 of fibrous glass or other insulating material which is intended to aid in confining heat as much as possible to the interior of the cavity 16 during operation of the oven. The door 28 is similarly filled with insulation and may or may not be provided with a heat-resistant transparent window structure 32. Below the oven cooking cavity is an air cavity 34 the top of which is defined by a transverse plate 35 or the like which serves as the oven floor 22. The back wall 18 of the oven cavity conveniently extends downwardly to form the back wall 36 of the air chamber 34. Oven cavity side walls 25 also project downwardly to form the side walls 38 of the air chamber 34. Back wall 36 and side walls 38 merge forwardly to form the bottom 40 of the air chamber 34.

Figure 3:
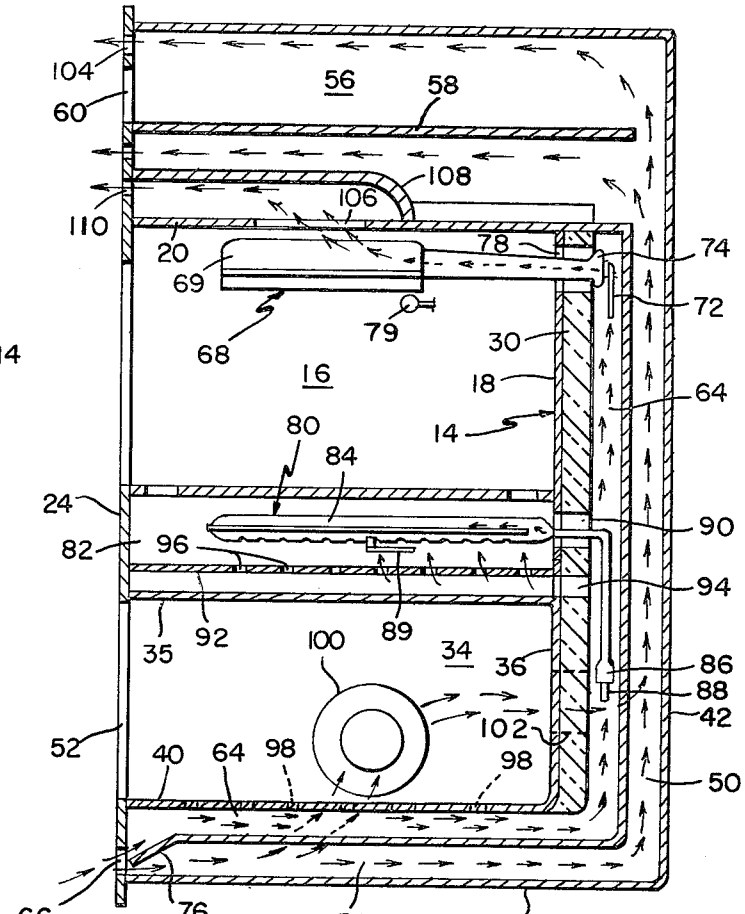
FIG. 3 is a vertical sectional view taken substantially along the line 3—3 of FIG. 2 looking in the direction of the arrows.
Figure 2:
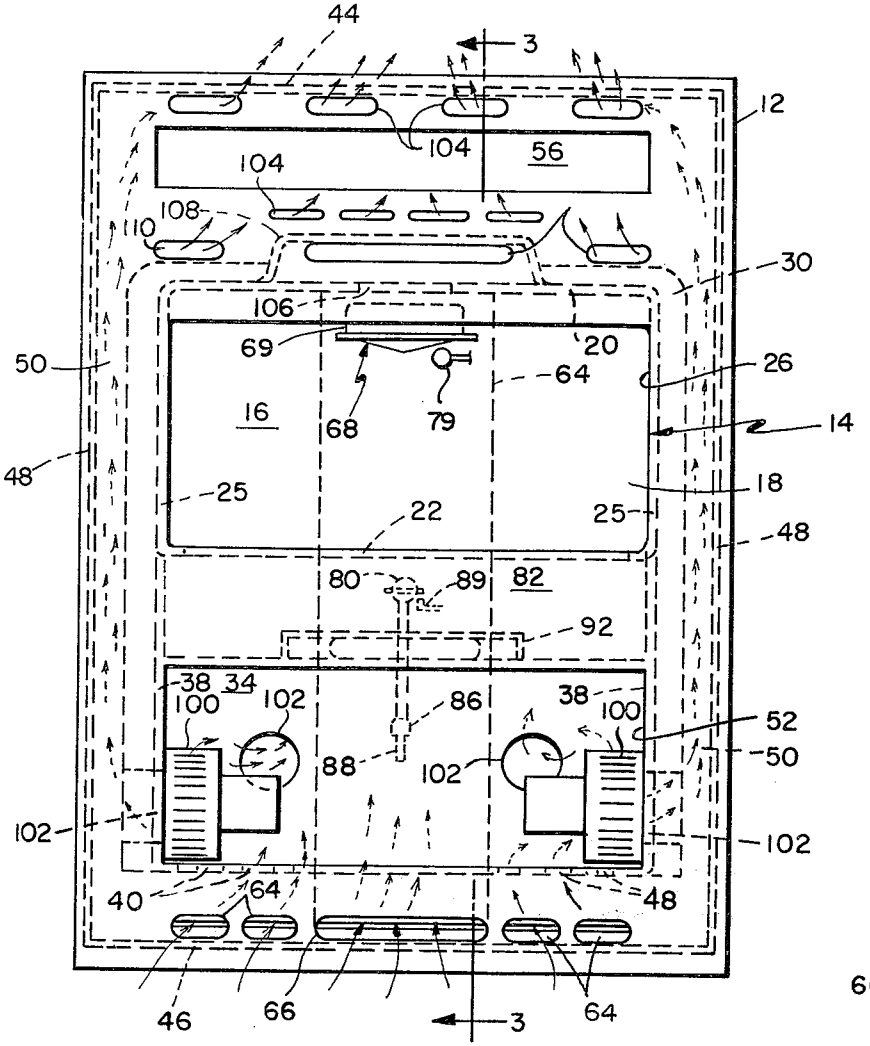
FIG. 2 is a vertical sectional view taken on a transverse plane immediately behind the front doors and panels and looking toward the rear of the oven.

A vertical rear wall 42 is spaced rearwardly from the rear wall 18 and insulation 30 of the oven liner 14 and from wall 36 of the air cavity 34, as shown best in FIG. 3, the wall 42 continuing forwardly above the oven cavity to form a top 44 and further extending beneath the air chamber bottom 40 to form a bottom or floor 46. Wall 34 also wraps itself around the sides of the body to form outer side walls 48. Thus there is formed a cooling air passageway or chamber 50 which extends completely around the back, top and sides of the liner 14, and around the air chamber or cavity 34.

The front wall 24 of the liner extends downwardly over the front of the air chamber 34 and is provided with an opening 52 for providing access to the air chamber. Opening 52 is normally covered by a door or removable panel 54.

At the upper end of the appliance above the oven cavity is a chamber 56 having a bottom wall 58 extending from the front wall 24 rearwardly above and spaced from the oven top wall 20 with its inner end terminating in spaced relation to rear wall 42 so that the passageway or chamber 50 is in open communication with the chamber 56. A front opening 60 provides access to the chamber 56 and is adapted to be covered by a control panel 62 details of which are not included herein.

A separate duct 64 extends within the described cooling air chamber 50 along the under side of the air chamber floor 40 and upwardly along the oven back wall 18. This duct 64 receives air at its lower end from a central opening 66 in wall 24 and supplies this air as combustion air to a broil burner 68. Burner 68 is located in the oven cavity 16 at the upper extremity thereof and is preferably of the type which is known as a radiant burner and which produces a broad sheet of flame or incandescence. One example of a radiant burner of a type suitable for use in the self-clean oven of the present invention is that disclosed in U.S. Pat. No. 3,122,197. Such a radiant burner 68 includes a burner head defining an open-sided cavity 69, and a mixing chamber such as a venturi 70 which has one end communicating with the burner cavity 69 and the other end adapted to receive gas from a pipe 72. The mixing chamber 70, for efficient and rapid combustion, is required to receive an ample supply of primary combustion air from duct 64. For example, ten parts of air to one part of gas is considered to be one satisfactory ratio in the case of natural gas. To insure an adequate supply of uncontaminated primary combustion air, the mixing chamber 70 is made in the nature of an oversized venturi and its outer end 74 is bell-shaped, as shown in FIG. 3. End 74 is considerably larger than and encircles the end of the outlet pipe 72 so that air from duct 64 can pass into the mixing chamber 70 along with the gas from pipe 72.

The pipe 72 is suitably connected through a control system (not shown) to a source of gaseous fuel. Duct 64 terminates at its upper end just above an opening 78 into which the end 74 of the mixing chamber 70 extends. The wall 76 of duct 64 adjacent the opening 66 is preferably slightly angled as shown in FIG. 3 so that the duct 64 and the cooling air chamber 50 both may share opening 66. A suitable igniter 79 is located adjacent the burner head 69 for ignition of the fuel at the surface of the burner.

A lower or bake burner 80 is located in a cavity 82 which lies between oven shelf 22 and the bottom wall 35. Burner 80 extends a substantial distance front to rear in the burner cavity 82 and is preferably of a conventional blue-flame type which includes a ported burner head 84 having a gas-receiving chamber for receiving gaseous fuel from a venturi or the like 86 which is suitably located in a pipe leading from the burner 80 so as to receive gas from a supply pipe 88 and to admixture the gas with air in the conventional and well-known manner. A suitable ignitor 89 is located adjacent the burner 80 so that jets of flame will be ignited at each of the ports in the head.

An opening 90 through the rear wall 18 and insulation 30 allows the venturi 86 to extend into the duct 64 so that primary combustion air can be admixed with gas in the venturi 86 so as to sustain combustion in the burner head 84. Beneath the burner 80 is another duct 92 which is fixed upon wall 35 parallel with the burner head 84. Rear wall 18 and insulation 30 are apertured as indicated at 94 so that the duct 92 may receive air from the duct 64, which air is allowed to pass upwardly from duct 92 through a series of openings 96 as secondary air for the burner.

It will be apparent that air which enters duct 64 through the central opening 66 will flow to the burners 80 and 68 by convection and by the inspirating effect provided by the burners. However, in accordance with this invention, cooling air is forcefully moved over the heated oven body entirely separate from the flow of combustion air. The cooling air is drawn through the openings 64 and the shared opening 66 into the portion of duct or passageway 50 which is at the bottom of the appliance. Openings 98 are provided in the bottom wall 40 of the air cavity 34 and one or more suction fans or blowers 100 are located in the air cavity 34 to forcefully draw cooling air through the openings 98 into the air cavity 34 and then force it out through additional opening 102 into the areas 50 at the sides and back of the appliance.

At the upper end of the appliance the cooling air, which has been somewhat heated by the heat within the oven, passes both beneath and above the wall 58 and exits through openings 104 in the front of the appliance. However, because of the relatively fast movement of the cooling air caused by the fans 100, the air exiting at openings 104 is not greatly heated.

During the operation of the burners 68 and 80 in normal bake and broil cycles, combustion products are allowed to escape from the oven 16 through an opening 106 in top wall 20 into a flue 108 which terminates at a separate opening or series of openings 110. When the oven is operated in the self-clean cycle, gaseous degradation products are removed by pyrolysis and also flow out through the flue 108. However, the opening 106 is located immediately above the radiant burner 68 so that the undesirable degradation products must pass through the burner flame, thus being incinerated and removed without the necessity for additional catalytic oxidizing units or the like.

It will be understood that the burners 68 and 80 may be operated individually and separately from one another for conventional baking and broiling operations.

However, both burners are operated simultaneously for performing a self-cleaning operation, although one burner may be operated for a short time before the other at the start of a self-cleaning operation, and one or both burners may be intermittently operated or modulated during a self-cleaning cycle in order to maintain a required temperature level.

The presently described self-cleaning oven operates to quickly raise the temperature in the interior of the oven to approximately 1,040° F., for example, although this may vary slightly, and then the mean temperature levels off at about 985° F., for example. It has been found that self-cleaning occurs at a temperature which, for most cooking materials, is above about 750° F. It is known that with higher temperatures, shorter time periods are required for food soils to be removed by pyrolytic action. The upper temperature levels may be established in accordance with the particular design of the oven; that is, higher temperatures and shorter time cycles may be used if heavier insulation and fire protection are provided. However, it has been found that a leveling off temperature of about 985° F. can be maintained with a gas oven which is properly designed and insulated as disclosed herein and that the temperatures of the outer walls of the appliance and of the surrounding walls will not become undesirably heated. It is to be understood, therefore, that the temperature and time cycles set forth herein are exemplary only and may vary from range to range or with different oven and range constructions.

The presently described gas-fueled oven can be raised to a temperature of about from 1,000°-1,040° F. within about 25-35 minutes, for example. It reaches the self-cleaning temperature of 750° F. in about 10 minutes, then continues up to the 1,040° F. level in about an additional 10-15 minutes, finally leveling off at about 985° F. for about 55-65 minutes, at which time the oven has become completely cleaned. Then, the control system shuts off the flow of fuel to the burners, and the oven is allowed to cool. In about 15-20 minutes the oven temperature is low enough to permit the oven door to be opened. Thus, the presently described oven operates above about 750° F. to self-clean for above 70-80 minutes and performs almost its entire cleaning during a period of about 55-65 minutes when it is actually above a level of 950° F., although admittedly a slight amount of cleaning starts to occur when the oven is being initially raised from the 750° F. level to the 950° F. level, which process may take from about 10-15 minutes.

It has been discovered that the range of compounds of which food soils are composed may be decomposed or degraded by heat during the time interval of about 70-80 minutes when above about 750° F., which process will produce substantial amounts of gaseous degradation products.

In the heat-cleaning cycle, a sweep of cool ambient air proceeds upwardly through the air cavity 34 and thence through the passageways 50 at the sides and back of the appliance. Some cool air, however, will bypass the air chamber 34 and continue directly through the horizontal portion of the duct 50 at the bottom into the vertical portion at the back. However, in either case, the forcibly moved cooling air is always independent of the flow of combustion air to the burners.

When the hot combustion air exits from flue 108 via opening 110, it will rise and immediately mix with the cooling air coming out of the openings 104 and thereby will become cooled. This will thus prevent greatly heated air from being exhausted into the surrounding atmosphere.

From the foregoing, it will be apparent that all of the objectives of this invention have been achieved by the gaseous-fueled self-cleaning oven disclosed herein. It will be understood, however, that several modifications in the invention and its manner of use may be made by those skilled in the art without departing from the spirit of the invention as expressed in the accompanying claims.

What is claimed is:

1. An oven comprising the combination of an oven compartment having top, bottom, back and side walls, a first burner in the oven compartment, an air chamber enclosing said top, bottom, back and side walls of the oven compartment, said air chamber having entrance opening at the front of the oven below the oven compartment and an exit aperture at the front of the oven above the oven compartment, an air cavity located beneath the oven compartment between the oven compartment and adjacent portions of said air chamber, said air cavity having apertured walls separating it from the adjacent portions of the air chamber, a burner box located between said bottom of said compartment and said air cavity, a second burner positioned in said burner box, a first duct located between said burner box and said air cavity, said first duct communicating with said burner box through a plurality of holes in the floor of said burner box for providing secondary combustion air to said second burner, a second duct located within said air chamber and extending from said entrance opening beneath said air cavity and upwardly along the back walls of said air cavity and compartment, said first and second burners extending into said second duct through respective apertures in said back wall of said compartment and the back wall of said burner box for receiving primary combustion air, said first duct communicating with said second duct for receiving said secondary combustion air, a plurality of blowers mounted on side walls of said air cavity for drawing in cooling air from said air chamber below said air cavity and for forcing said cooling air into said air chamber at the sides and back of said air cavity, said cooling air being substantially isolated from said primary and secondary air.

2. An oven as set forth in claim 1 further comprising an exhaust duct located within the air chamber and communicating at one end with the oven compartment for removal of combustion air.

3. An oven as set forth in claim 2 wherein the oven is provided above the oven compartment with aperture means for exhaust of cooling air from the air chamber and combustion air from the exhaust duct.

4. An oven as set forth in claim 3 wherein said aperture means comprises a first aperture communicating with said air chamber, and a second aperture communicating with the exhaust duct, the second aperture being located beneath said first aperture whereby heated combustion air from the oven compartment upon rising from the second aperture will mix with cooling air from the first aperture.

5. A built-in self-cleaning oven comprising the combination of an oven compartment having top, bottom, back and side walls, a broil burner located in an upper portion of the oven compartment, a bake burner located in a lower portion of the oven compartment, an air cavity beneath the bottom wall of the oven compartment and having back, bottom and side walls, an air chamber enclosing the backs and sides of the oven compartment and the air cavity, the bottom wall of the air cavity and the top wall of the oven compartment, an oven shelf above the bake burner, an apertured duct beneath the bake burner, a combustion air duct within the air chamber and extending beneath the air cavity and upwardly along the back walls of the air cavity and oven compartment, said burners being connected with said air duct to receive primary combustion air therefrom, said apertured duct being connected with the combustion air duct to receive therefrom secondary combustion air for the bake burner, an exhaust duct in the portion of the air chamber above the oven compartment, an opening in the top wall of the oven compartment communicating with said exhaust duct, the broil burner being located in the oven compartment at said opening whereby combustion products being exhausted from the oven compartment will be incinerated by said broil burner, and a blower mounted in said air cavity for drawing in cooling air from said air chamber through holes in said bottom wall of said air cavity and for generating a flow of cooling air upwardly through said air chamber enclosing said sides and backs respectively of said air cavity and said compartment, said cooling air being substantially isolated from said primary and secondary combustion air.

6. An oven as set forth in claim 5 wherein the bottom, back and side walls of the air cavity are apertured to provide communication between the air cavity and adjacent portions of the air chamber, and at least one blower is located in the air cavity for forcing cooling air through the air cavity into and through the air chamber.

7. An oven as set forth in claim 6 wherein front apertures are provided below the oven cavity in communication with both said combustion air duct and said air chamber for passage of air separately thereinto.

8. An oven as set forth in claim 6 wherein the oven is provided with exit air aperture means located in the front thereof above the oven compartment and communicating with both the air chamber and the exhaust duct for exhaust of cooling air from the air chamber and combustion air from the exhaust duct.

9. An oven as set forth in claim 8 wherein said aperture means comprises first and second apertures, the first aperture communicating with said air chamber for exit of cooling air therefrom, and a second aperture communicating with the exhaust duct for exit of heated combustion air from the oven compartment.

10. An oven as set forth in claim 9 wherein said second aperture is located beneath said first aperture whereby heated combustion air upon rising from the second aperture will mix with cooling air passing from the first aperture.

* * * * *